US010151313B2

(12) United States Patent
Desiron

(10) Patent No.: US 10,151,313 B2
(45) Date of Patent: Dec. 11, 2018

(54) COMPRESSOR DEVICE AS WELL AS THE USE OF SUCH A COMPRESSOR DEVICE

(75) Inventor: Andries Jan F. Desiron, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 372 days.

(21) Appl. No.: 14/380,462

(22) PCT Filed: Jun. 27, 2012

(86) PCT No.: PCT/BE2012/000032

§ 371 (c)(1),
(2), (4) Date: Aug. 22, 2014

(87) PCT Pub. No.: WO2013/126969

PCT Pub. Date: Sep. 6, 2013

(65) Prior Publication Data

US 2015/0030491 A1 Jan. 29, 2015

(30) Foreign Application Priority Data

Feb. 28, 2012 (BE) ..... 2012/0119

(51) Int. Cl.
*F04C 18/16* (2006.01)
*F04C 23/00* (2006.01)
(Continued)

(52) U.S. Cl.
CPC ..... *F04C 18/16* (2013.01); *F04C 23/008* (2013.01); *F04C 28/06* (2013.01); *F04C 29/021* (2013.01); *F04C 29/045* (2013.01)

(58) Field of Classification Search
CPC ..... F04D 25/08; F04B 39/02; F04B 39/0207; F04B 2205/01; F04B 2205/02;
(Continued)

(56) References Cited

U.S. PATENT DOCUMENTS 3,495,887 A * 2/1970 Hay ..... F16C 19/06 384/535
3,558,248 A 1/1971 Parker
(Continued)

FOREIGN PATENT DOCUMENTS

BE 1014301 A3 8/2003
CA 1034932 A 7/1978
(Continued)

OTHER PUBLICATIONS

Chinese Office Action dated Dec. 3, 2015, for CN 201280070799.0, and English translation thereof.
(Continued)

*Primary Examiner* — Patrick Hamo
*Assistant Examiner* — Joseph Herrmann
(74) *Attorney, Agent, or Firm* — Bacon & Thomas, PLLC

(57) ABSTRACT

Compressor device that is at least provided with a screw compressor with a compression chamber that is formed by a compression housing, with a drive motor that is provided with a motor chamber formed by a motor housing and with an outlet for the discharge of compressed air that is connected to a pressure vessel via an outlet pipe, whereby the compression housing and the motor housing are connected directly to one another to form a compressor housing, whereby the motor chamber and the compression chamber are not sealed off from one another and whereby the outlet pipe between the pressure vessel and the screw compressor is free of closing means.

37 Claims, 2 Drawing Sheets

(51) Int. Cl.
*F04C 28/06* (2006.01)
*F04C 29/02* (2006.01)
*F04C 29/04* (2006.01)

(58) Field of Classification Search
CPC ..... F04B 2205/10; F04B 49/22; F04B 53/10; F04B 39/0215; F04B 39/06; F04B 53/08; F04C 29/0085; F04C 29/045; F04C 18/16; F04C 29/021; F04C 23/008; F04C 28/06; F04C 15/064; F04C 2270/58; F04C 29/124
USPC ..... 417/228, 298, 310, 371, 410.4; 418/203, 418/197, 83; 310/54; 384/322, 399
See application file for complete search history.

(56) References Cited

U.S. PATENT DOCUMENTS 3,788,776 A 1/1974 Post et al.
3,790,309 A * 2/1974 Volz ..... F04C 2/165 417/368
3,922,114 A 11/1975 Hamilton
4,063,855 A 12/1977 Paul
4,180,986 A 1/1980 Shaw
4,291,547 A 9/1981 Leo
4,547,135 A * 10/1985 Noel ..... F04C 11/008 417/360
4,878,820 A * 11/1989 Doi ..... F04C 29/0021 384/322
5,222,874 A * 6/1993 Unnewehr ..... F04C 29/042 417/372
5,246,349 A 9/1993 Hartog
5,531,571 A 7/1996 Van Dyck
5,697,763 A * 12/1997 Kitchener ..... F04C 28/06 417/28
5,797,980 A * 8/1998 Fillet ..... B01D 53/22 55/DIG. 17
6,364,645 B1 * 4/2002 Dieterich ..... F01C 21/10 418/201.1
6,595,761 B2 * 7/2003 Otsuka ..... F04C 18/16 417/359
6,652,250 B2 11/2003 Yoshimura
7,052,252 B2 * 5/2006 Hunsberger ..... F04C 14/24 417/220
7,316,546 B2 * 1/2008 Daniels ..... F04C 18/16 417/295
7,413,419 B2 * 8/2008 De Smedt ..... F04C 29/02 417/410.3
8,226,378 B2 * 7/2012 Daniels ..... F04C 18/16 417/228
2001/0046443 A1 * 11/2001 Van De Putte ..... F04C 18/16 417/44.2
2002/0168280 A1 11/2002 Zhong
2004/0146414 A1 * 7/2004 Nichol ..... F01C 21/102 417/410.4
2004/0151602 A1 * 8/2004 Daniels ..... F04C 18/16 417/298
2005/0089432 A1 * 4/2005 Truyens ..... F04C 18/16 418/83
2007/0207045 A1 * 9/2007 Sundstrom ..... F04C 28/08 417/410.4
2007/0241627 A1 * 10/2007 Kharsa ..... F04C 18/16 310/156.08
2010/0247361 A1 9/2010 Nemit, Jr. et al.
2010/0254845 A1 * 10/2010 Nemit, Jr. ..... F04C 18/16 418/201.2

FOREIGN PATENT DOCUMENTS

CN 101440813 A 5/2009
CN 201827074 U 5/2011
DE 2329799 A1 2/1974
DE 2715610 A1 10/1977
EP 0538973 A1 4/1993
EP 0629778 A2 12/1994
EP 1128067 A1 8/2001
GB 1557296 12/1979
JP S54-154813 A 12/1979
JP S59215986 A 12/1984
JP H11351168 A 12/1999
WO 03/008808 A1 1/2003
WO 03/019010 A1 3/2003
WO 2005-038258 A1 4/2005
WO WO 2005038258 A1 * 4/2005 ..... F04C 29/0007
WO 2008/014433 A1 1/2008

OTHER PUBLICATIONS

European Third Party Observations dated Aug. 19, 2016, for EP 12743354.8.
International Search Report (ISR) dated Nov. 13, 2012, for PCT/BE2012/000032.
International Search Report (ISR) dated Dec. 5, 2012, for PCT/BE2012/000033.
European Third Party Observations dated Jan. 17, 2017, for EP 12758989.3.
European Third Party Observations dated Aug. 19, 2016, for EP 12758989.3.
Russian Office Action dated Jan. 29, 2016, for RU 2014138930, and English translation thereof.

* cited by examiner

COMPRESSOR DEVICE AS WELL AS THE USE OF SUCH A COMPRESSOR DEVICE

BACKGROUND OF THE INVENTION

More specifically the present invention relates to a compressor device that is at least provided with screw compressor with a compression chamber that is formed by a compression housing, in which a pair of meshed compressor rotors are rotatably mounted, with a drive motor that is provided with a motor chamber formed by a motor housing, in which a motor shaft is rotatably mounted that drives at least one of the aforementioned two compressor rotors, with an inlet to the screw compressor for supplying air, with an outlet from the screw compressor for the discharge of compressed air and which is connected to a pressure vessel via an outlet pipe, with an air outlet from the pressure vessel for supplying the compressed air from the pressure vessel to a consumer, and with a control system for controlling one or more liquid or gas flows in the pneumatic assembly, said control system being provided with an inlet valve at the inlet of the screw compressor and a tap or valve for closing and opening the air outlet of the pressure vessel.

Such compressor devices are already known, which however present a number of disadvantages or which are open to improvement.

Indeed, in the most well known such compressor devices, the screw compressor is driven at a constant speed of rotation by a separate drive motor that is supplied directly from the supply network.

In order to be able to adjust the airflow through the screw compressor, an inlet valve is provided at the inlet of such known screw compressors.

This inlet valve also acts to limit the required torque that has to be delivered by the drive motor when starting up the screw compressor, whereby to limit the required start-up torque the inlet valve is closed during start-up.

On the other hand, in such known compressor devices, after the screw compressor has stopped the compressed air pumped into the pressure vessel by the screw compressor is simply released, again with the intention of limiting the start-up torque as much as possible when restarting the screw compressor.

Starting up with the compression chamber of the screw compressor under pressure would require a very high torque from the drive motor in such compressor devices with a constant speed drive.

If the aforementioned measures were not taken, then the drive motor would not be able to develop enough torque during start-up, or the supply network would not be able to supply the necessary start-up current to develop the high start-up torque.

A considerable disadvantage of these known compressor devices is that a lot of energy is lost through the compressed air already stored in the pressure vessel and in the screw compressor being lost after the screw compressor has stopped.

In another known improved type of compressor device, a solution to the aforementioned disadvantages is partially provided by equipping the screw compressor with a variable speed drive.

In this known type of compressor device the airflow through the screw compressor is adjusted by adapting the speed of rotation of the drive motor, such that no inlet valve is required for this purpose.

Furthermore, when starting up the screw compressor in such a known compressor device, use can also be made of an electronic controller in order to realise a higher starting torque or to limit the starting current drawn from the supply network.

An additional advantage of the application of such an electronic controller is that the compressed air in the pressure vessel does not necessarily have to be released when the screw compressor has stopped, as sufficient torque can be developed when starting up to overcome the pressure in the pressure vessel.

In this way it can be ensured that when the screw compressor is stopped, less energy is lost than with known compressor devices with a constant speed drive.

However, in order to be able to realise this, in the assembly a non-return valve first and foremost has to be provided in the outlet pipe between the outlet of the screw compressor and the pressure vessel, to prevent the compressed air present in the pressure vessel expanding and escaping via the outlet pipe after the screw compressor has stopped, under the influence of the pressure difference between the pressure vessel and the compression chamber of the screw compressor or the ambient pressure.

Moreover, with oil-injected screw compressors an oil separator is normally provided in the pressure vessel, in which oil is separated from the compressed air flow originating from the screw compressor and is guided back to the screw compressor via an oil return pipe affixed between the pressure vessel and the screw compressor.

In such a case when the screw compressor is stopped, the separated oil in the pressure vessel flowing back to the screw compressor must be prevented, as otherwise this would lead to an excess of oil in the screw compressor and could also impede the restart of the screw compressor.

Hence in the known compressor devices of the type discussed above, a non-return valve always has to be provided in the oil return pipe.

A disadvantage of the aforementioned non-return valves is that they give rise to large friction losses.

Moreover, the volume of compressed air in the screw compressor itself is always lost when the screw compressor is stopped, as this compressed air can escape through the inlet of the screw compressor.

Hermetically sealing the inlet by means of an inlet valve with the intention of leaving the screw compressor under pressure when stopped provides no solace here.

In order to be able to drive the compressor rotors, in the known compressor devices generally the motor shaft of the drive motor is directly or indirectly, for example via a drive belt or a gearwheel transmission, coupled to the rotor shaft of one of the compressor rotors.

Hereby the rotor shaft of the compressor concerned must be adequately sealed, which is far from easy.

Indeed, a certain pressure supplied by the screw compressor prevails in the compression housing, which has to be screened off from the compressor sections that are not under this pressure or from the ambient pressure.

For such applications, a "contact seal" is often used.

The application of a sealed inlet valve after the screw compressor has stopped would thus carry a high risk of the occurrence of leaks in the rotor shaft seal.

Moreover, the restart of the screw compressor, when it is under pressure, will be coupled with high friction losses, such that the seal can be easily damaged.

Another disadvantage of the known compressor devices relates to the seal itself of the screw compressor.

The rotor shaft of the compressor rotor concerned turns at very high speeds, such that such a type of seal brings about enormous power losses during the operation of the screw compressor, resulting in a reduced efficiency of the screw compressor.

Moreover, such a "contact seal" is subject to wear, and if it is not carefully installed such a "contact seal" is very sensitive to the occurrence of leaks.

Another aspect of the known compressor devices of the type described above that is open to improvement, is that both the drive motor and the screw compressor have to be provided with lubrication and cooling, that generally consist of separate systems and thus are not attuned to one another, require a number of different types of lubricants and/or coolants, and are thereby complicated or expensive.

In addition, in such known compressor devices with separate cooling systems for the drive motor and compressor rotors, the possibilities for recovering the lost heat stored in the coolants in an optimum way are not fully utilised.

SUMMARY OF THE INVENTION

The purpose of the invention is thus to provide a solution to one or more of the foregoing disadvantages and any other disadvantages.

More specifically it is an objective of the invention to provide a compressor device, whereby the energy losses are minimised and in particular when the screw compressor is stopped, the loss of compressed air is limited as much as possible.

Moreover, it is an objective of the invention to realise a compressor device that is robust and simple, whereby the risk of wear and leaks are kept to a minimum, whereby the lubrication of bearings and the cooling of components is realised by very simple means and whereby improved recovery of the heat losses occurring can be achieved.

To this end the invention concerns a compressor device comprising a compression housing and a motor housing that are connected directly to one another to form a compressor housing, whereby the motor chamber and the compression chamber are not sealed off from one another and whereby the outlet pipe between the pressure vessel and the screw compressor is free of closing means in order to enable a flow through the outlet pipe in both directions.

Hereby it is the intention that the flow through the outlet pipe can take place unimpeded as much as possible, not including the friction losses, whereby under no circumstances are non-return valves or similar provided that only enable a flow, in one direction through the outlet pipe.

A first big advantage of such a screw compressor according to the invention is that the compressor housing forms a whole, consisting of a compression housing and motor housing that are directly connected together, so that the drive means of the compressor rotors, in the form of a drive motor, are integrated directly in the screw compressor.

It should be noted here that the compression chamber and the motor chamber do not have to be sealed off from one another, as due to the direct installation of the motor housing and compression housing together, the motor shaft and one of the compressor rotors can be coupled completely within the contours of the compressor housing, without having to pass through a section that is at a different pressure, such as is usual in the known screw compressors, for example, whereby the motor shaft is coupled to a compressor rotor, whereby a section of the coupling is exposed to the ambient pressure.

The characteristic that such a seal between the compression chamber and the motor chamber is not necessary, constitutes a considerable advantage of a compressor device, according to the invention, as a higher energy efficiency of the screw compressor is obtained than with the known compressor devices, and no wear of such a seal is possible and leaks as a result of the poor installation of such a seal are avoided.

Another very important aspect of a screw compressor according to the invention is that due to the absence of a seal between the motor chamber and the compression chamber, a closed whole is obtained that is resistant to the application of long term high pressures, without leaks being able to occur in a seal of the rotor shaft of a compressor rotor, as is indeed the case with the known compressor devices.

As a result the pressure, which has been built up in the compression chamber and motor chamber during the operation of the screw compressor, is maintained after the screw compressor has stopped, as this pressure is no longer harmful, which according to the invention is preferably realised in a simple way by using a non-controlled or self-regulating inlet valve, preferably in the form of a non-return valve.

Moreover, a restart of the screw compressor from the aforementioned state under pressure is no longer problematic, as is indeed the case with the known compressor devices, as no friction losses occur in a seal on the rotor shaft, as such a seal is no longer applied.

Thus a great energy saving is achieved, as the stoppage of the screw compressor is no longer coupled with significant loss of compressed air.

In addition, this enables the decision to stop the screw compressor to be taken more quickly, when compressed air is temporarily not required for example, as a restart can be done more quickly and requires less energy than the known compressor devices on account of the pressure already present in the pressure vessel and the compression chamber, while with the known compressor devices in similar circumstances it will often rather be decided to operate the screw compressor in neutral.

This again means a large energy saving.

With a compressor device according to the invention it must be ensured that the drive motor is of a type that can withstand the compressor pressure, such that a specially adapted drive motor has to be used.

In order to be able to realise the above-mentioned advantages according to the invention, it is best if the drive motor is of a type that can generate a sufficiently high starting torque in order to start the screw compressor when the compression chamber is under compressor pressure.

In brief the possibilities of the invention are determined to a large extent by the selection of a good drive motor.

Another advantage of the compressor device according to the invention is that the outlet pipe is free of closing means, whereby friction losses in non-return valves and similar are avoided.

It is possible and useful to construct the compressor device without closing means in the outlet pipe, as by closing off the screw compressor on its inlet using the self-regulating inlet valve and closing the pressure vessel on its air outlet and oil outlet, a hermetically sealed whole is obtained via the outlet pipe, consisting of the pressure vessel connected to the compression chamber and the motor chamber via the outlet pipe, whereby this sealed whole is more or less under a uniform pressure.

As the pressure in the aforementioned hermetically sealed whole is the same everywhere, there is no driving force that makes the compressed air and oil in the pressure vessel flow back from the pressure vessel to the screw compressor, as is the case with the known compressor devices, which thus enables the omission of non-return valves in the outlet pipe.

In brief, the integration of the drive motor in the screw compressor and the non-use of a seal on the rotor shaft, enables a considerable simplification of the control system of the compressor device, whereby large energy benefits are also obtained by not having to release compressed air and energy losses not occurring in non-return valves in the outlet pipe or the oil return pipe.

Another advantageous aspect of a compressor device according to the invention is that the same lubricants and coolants can be used in a very simple way for both the drive motor and the compressor rotors, as the motor chamber and the compression chamber are not separated from one another by a seal.

According to a preferred embodiment of a compressor device according to the invention, the screw compressor is preferably provided with a fluid, for example an oil, with which both the drive motor and the screw compressor are cooled and/or lubricated.

Thus the design of the compressor device according to the invention is greatly simplified, fewer different coolants and/or different lubricants are needed, and the whole can thus be constructed more cheaply.

Moreover, it is the case that by having a fluid circulate during a single cycle both along the drive motor and along the compressor elements to cool the compressor device, this fluid undergoes a greater temperature change than when separate cooling systems are used for the drive motor and the compressor rotors.

Indeed, this fluid will absorb heat from both the drive motor and the compressor elements instead of just heat from one of the two components.

A consequence of this is that the heat stored in the fluid can be more easily recovered than when the fluid only undergoes a small temperature change.

However, account must be taken of the fact that a different operating temperature will have to be chosen for the drive motor or the compressor rotors.

The invention also relates to the use of an aforementioned compressor device, whereby such use means that when starting up the screw compressor, whereby no pressure is built up in the pressure vessel, the inlet valve opens automatically due to the operation of the screw compressor and a compression pressure is built up in the pressure valve, and whereby moreover when the screw compressor is stopped, a non-return valve on the pressure vessel automatically closes the air outlet of the pressure vessel, and whereby the inlet valve also automatically hermetically seals the inlet pipe, so that, after the screw compressor has stopped, both the pressure vessel and the compression chamber and motor chamber of the screw compressor remain under compression pressure.

Preferably, according to a use of the compressor device according to the invention, when restarting the screw compressor, whereby a compression pressure is still present in the pressure vessel, the inlet valve first closes, after which the inlet valve opens automatically under the suction effect created by the rotation of the compressor rotors.

BRIEF DESCRIPTION OF THE DRAWINGS

With the intention of better showing the characteristics of the invention, a preferred embodiment of a compressor device according to the invention is described hereinafter by way of an example, without any limiting nature, with reference to the accompanying drawings, wherein.

DETAILED DESCRIPTION OF THE INVENTION

Figure 1:
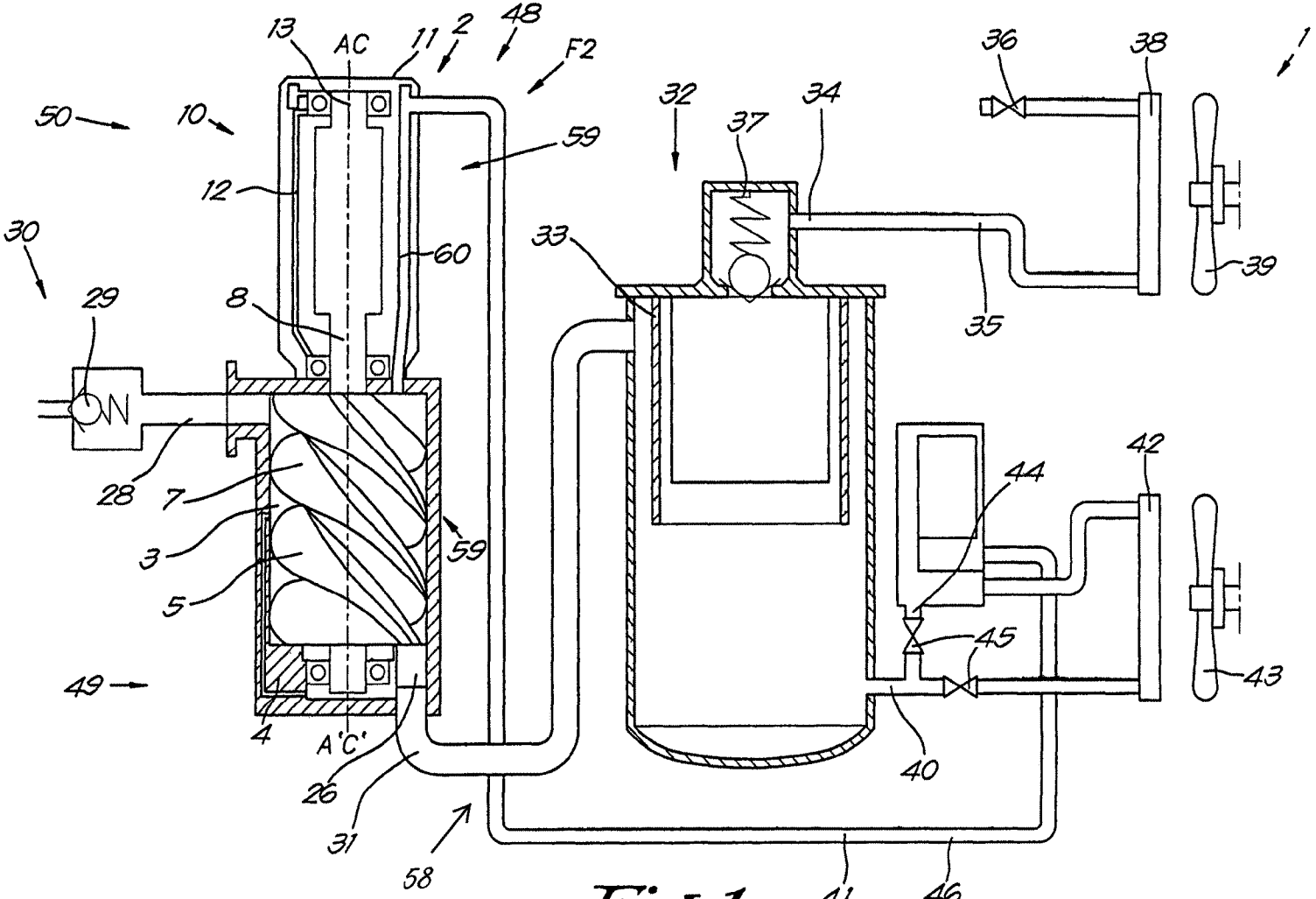
FIG. 1 schematically shows a compressor device according to the invention; and, FIG. 2 shows a cross-section, in more detail, of the screw compressor of the compressor device indicated by F2 in FIG. 1.
Figure 2:
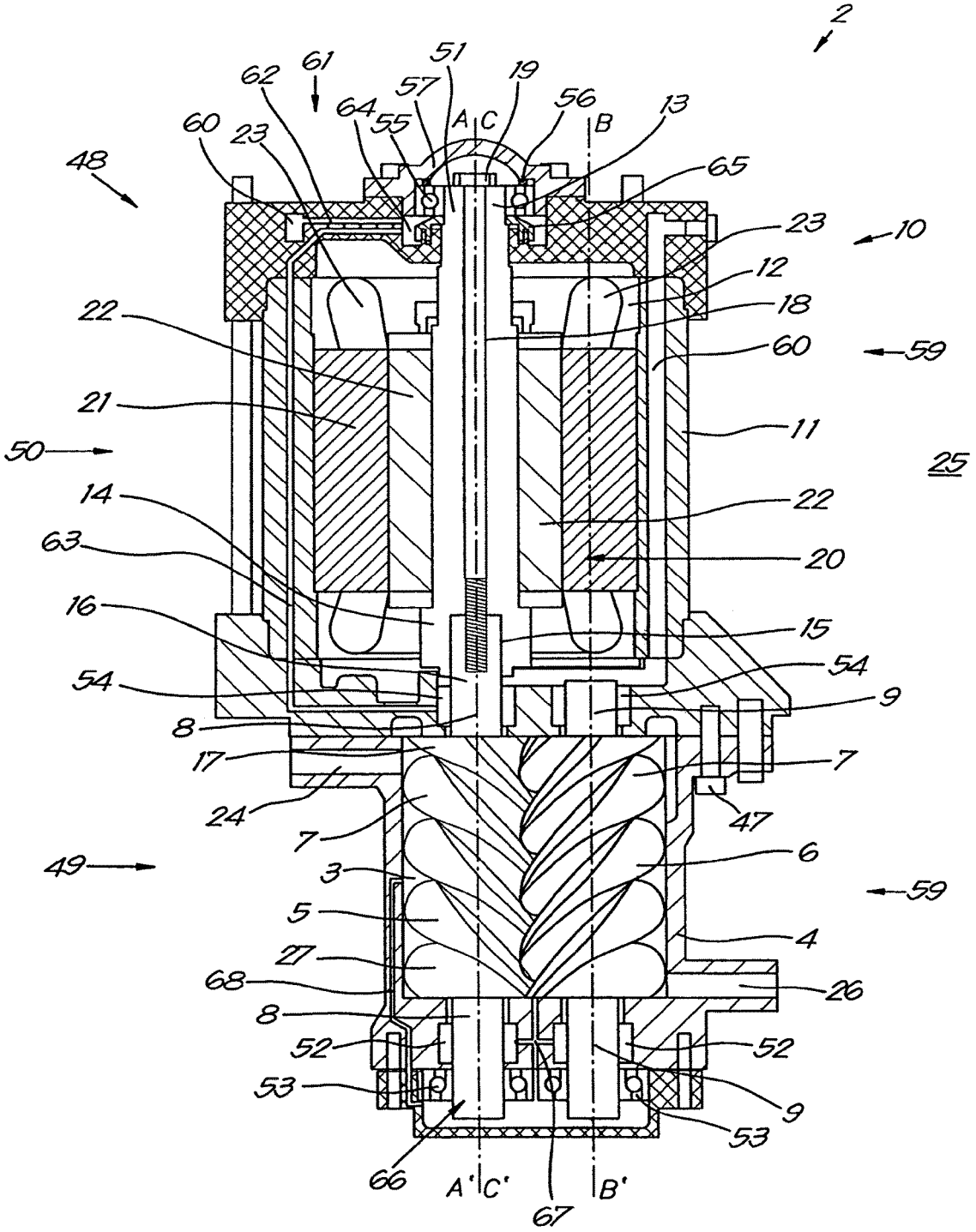

The compressor device 1 according to the invention shown in FIG. 1 first and foremost comprises a screw compressor 2, that is shown in more detail in FIG. 2, whereby this screw compressor 2 has a compression chamber 3 that is formed by a compression housing 4.

In the compression chamber 3 a pair of meshed compressor rotors are rotatably mounted, more specifically a first compressor rotor 5 and a second compressor rotor 6.

These compressor rotors 5 and 6 have a helical profile 7 that is affixed around a rotor shaft of the compressor rotor 5 and 6 concerned, respectively rotor shaft 8 and rotor shaft 9.

Hereby the rotor shaft 8 extends along a first axial direction AA', while the rotor shaft 9 extends along second axial direction BB'.

Moreover, the first axial direction AA' and the second axial direction BB' are parallel to one another.

Moreover, the screw compressor is provided with a drive motor 10.

This drive motor 10 is provided with a motor housing 11 that is affixed closely above the compression housing 4 and whose inside walls enclose a motor chamber 12.

In the motor chamber 12, a motor shaft 13 of the drive motor 10 is rotatably mounted, and in the embodiment shown this motor shaft 13 is directly coupled to the first compressor rotor 5 in order to drive it, but this does not necessarily need to be the case.

The motor shaft 13 extends along a third axial direction CC', which in this case also coincides with the axial direction AA' of the rotor shaft 8, so that the motor shaft 13 is in line with the compressor rotor 5 concerned.

To couple the motor shaft 13 to the compressor rotor 5, one end 14 of the motor shaft 13 is provided with a cylindrical recess 15 in which the end 16 of the rotor shaft 8, that is located close to a low pressure end 17 of the compressor rotor 5, can be suitably inserted.

Moreover, the motor shaft 13 is provided with a passage 18 in which a bolt 19 is affixed, which is screwed into an internal screw thread provided in the aforementioned end 16 of the rotor shaft 8.

Of course there are many other ways of coupling the motor shaft 13 to the rotor shaft 8, which are not excluded from the invention.

Alternatively it is indeed not excluded that a screw compressor 2 according to the invention is constructed such that the motor shaft 13 also forms the rotor shaft 8 of one of the compressor rotors 5, by constructing the motor shaft 13 and rotor shaft 8 as a single piece, such that no coupling means are needed for coupling the motor shaft 13 and rotor shaft 8.

Moreover, in the example shown in FIGS. 1 and 2, the drive motor 10 is an electric motor 10 with a motor rotor 20 and motor stator 21, whereby more specifically in the example shown the motor rotor 20 of the electric motor 10 being provided with permanent magnets 22 to generate a rotor field, while the motor stator 21 being provided with electrical windings 23 to generate a stator field that is switched and acts in a known way on the rotor field in order to bring about a rotation of the motor rotor 20, but other types of drive motors 10 are not excluded according to the invention.

Moreover, there is an inlet 24 through the walls of the compression housing 4 up to the compression chamber 3 for drawing in air, for example air from the surrounds 25 or originating from a previous compressor stage, as well as an outlet 26 for the discharge of compressed air, for example to a compressed air consumer or a subsequent compressor stage.

The compression chamber 3 of the screw compressor 2 is, as is known, formed by the inside walls of the compression housing 4, which have a form that closely fit the external contours of the pair of compressor rotors 5 and 6 in order to drive the air drawn in via the inlet 24, during the rotation of the compressor rotors 5 and 6, between the helical profile 8 and the inside walls of the compression housing 4 in the direction of the outlet 26, and thus to compress the air, and to build up pressure in the compression chamber 3.

The direction of rotation of the compressor rotors 5 and 6 determines the drive direction and thus also determines which of the passages 24 and 26 will act as the inlet 24 or the outlet 26.

The inlet 24 is hereby at the low pressure end 17 of the compressor rotors 5 and 6, while the outlet 26 is near the high pressure end 27 of the compressor rotors 5 and 6.

An inlet pipe 28 is hereby connected to the inlet 24 of the screw compressor 1 in which there is an inlet valve 29, which enables the inflow of the air supply to the screw compressor 2 to be controlled.

This inlet valve 29 forms part of a control system 30 for controlling the liquid and gas flows in the compressor device 1.

An outlet pipe 31 is connected to the outlet 26 that leads to a pressure vessel 32 that being provided with an oil separator 33.

The pressure vessel 32 has an air outlet 34 for supplying compressed air from the pressure vessel 32 to a consumer.

To this end a consumer pipe 35, which can be closed by a tap or valve 36, is connected to the air outlet 34 of the pressure vessel 32.

This tap or this valve 36 also forms part of the aforementioned control system 30 for controlling the liquid and gas flows in the compressor device 1.

The air outlet 34 of the pressure vessel 32 is also equipped with a non-return valve 37.

Moreover, a section 38 of the consumer pipe 35 is constructed as a radiator 38 that is cooled by means of forced airflow of surrounding air 25 originating from a fan 39, of course with the intention of cooling the compressed air.

There is also an oil outlet 40 on the pressure vessel 32, on which an oil return pipe 41 is affixed that is connected to the motor housing 11 of the drive motor 10 of the screw compressor 2.

A section 42 of the oil return pipe 41 is also constructed as a radiator 42, which is cooled by a fan 43.

In this case a bypass pipe 44 is also provided in the oil return pipe 41 that is affixed in parallel over the section of the oil return pipe 41 with radiator 42, but this is not strictly necessary.

Via one or more controlled valves 45, a fluid such as oil 46 can be sent through the section 42 of the oil return pipe 41, in order to cool the oil 46, for example during the normal operation of the screw compressor 2, or through the bypass pipe 44 in order not to cool the oil 46, such as during the start-up of the screw compressor 2, for example.

During the operation of the screw compressor 2, compressed air, mixed with oil 46 that preferably acts as a lubricant and coolant for the screw compressor 2, leaves the screw compressor 2 through the outlet 26, whereby this mixture is separated into two flows in the pressure vessel 32 by the oil separator 33, on the one hand an outflow of compressed air via the air outlet 34 above the pressure vessel 32, and on the other hand an outflow of fluid or oil 46 via the oil outlet 40 at the bottom of the pressure vessel 32.

The controlled valves 45 and even the oil separator 33 in itself can also be considered as components of the aforementioned control system 30 for controlling the liquid and gas flows in the compressor device 1.

It is highly characteristic of the invention that the compression housing 3 and the motor housing 15 are connected directly together, in this case by bolts 47, to form a compressor housing 48 of the screw compressor 2, whereby more specifically the motor chamber 12 and the compression chamber 3 are not sealed off from one another.

In the example shown the compression housing 4 and the motor housing 15 are actually constructed as separate parts of the compressor housing 48, that more or less correspond to the parts of the screw compressor 2 that respectively contain the drive motor 10 and the compressor rotors 5 and 6.

However, attention is drawn here to the fact that the motor housing 11 and the compression housing 4 do not necessarily have to be constructed as such separate parts, but just as well can be constructed as a single whole.

As an alternative it is not excluded that the compressor housing 48 is constructed from more or fewer parts, that entirely or partially contain the compressor rotors 5 and 6 or the drive motor 10 or all these components together.

It is essential for the invention that, in contrast to what is the case with known compressor devices, no seal is used that separates the motor chamber 12 and the compression chamber 3 from one another, which for this reason alone, as explained in the introduction, is a considerable advantage of a screw compressor 2 according to the invention, on account of the lower energy losses, less wear and lower risk of leaks.

Because the motor chamber 12 and the compression chamber 3 are constructed as a closed whole, other components of a compressor device 1 according to the invention can be constructed more simply than is the case with the known compressor devices.

An important characteristic of a compressor device 1 according to the invention is that the outlet pipe 31 between the pressure vessel 32 and the screw compressor 2 is free of closing means in order to enable a flow through the outlet pipe 31 in both directions, such that this flow can preferably take place as unimpeded as possible and the friction losses are thus limited as much as possible.

A great advantage of such a compressor device 1 according to the invention is that its control system 30 for controlling the gas and liquid flows in the compressor device 1 is much simpler than with the known compressor devices 1.

More specifically only an inlet valve 29 is needed to obtain the correct operation of the screw compressor 2.

Moreover, a more energy-efficient operation can be achieved even with this one valve 29.

Indeed, with a compressor device 1 according to the invention the drive motor 10 is integrated in the compressor housing 48, whereby the motor chamber 12 and the compression chamber 3 are not sealed off from one another, so that the pressure in the pressure vessel 32 and the pressure in the compression chamber 3, as well as in the motor chamber 12 are practically equal after the screw compressor 2 has stopped.

Consequently when the screw compressor 2 is stopped, the oil 46 present in the pressure vessel 32 will not be inclined to flow back to the screw compressor 2, and more specifically the drive motor 10, as is indeed the case with the known screw compressors whereby the pressure in the drive motor is generally the ambient pressure.

With known screw compressors, a non-return valve always has to be provided in the oil return pipe 41, which is not the case with a compressor device 1 according to the invention.

Analogously, with the known compressor devices a non-return valve is provided in the outlet pipe 31, in order to prevent the compressed air in the pressure vessel being able to escape via the screw compressor and the inlet when the screw compressor is stopped.

With a compressor device 1 according to the invention it is sufficient to hermitically close off the inlet 24 to the screw compressor 2, and to close off the air outlet 34 from the pressure vessel 32, when the screw compressor 2 is stopped, so that both the pressure vessel 32 and the compression chamber 3 and motor chamber 12 remain under compression pressure after the compressor device 1 has stopped.

Preferably the inlet valve 29 according to the invention is a self-regulating non-return valve 29, and a self-regulating non-return valve is provided on the air outlet 34 from the pressure vessel 32, so that the closing of the inlet 24 and the air outlet 34 when the compressor device 1 is stopped is done automatically without any intervention by an operator or control system.

This is not possible with known compressor devices, as they are always provided with a seal that separates the motor chamber and the compression chamber from one another, generally realised by means of a seal on the rotating rotor shaft.

Keeping the compression chamber under pressure with known compressor devices would give rise to damage of this seal.

An advantage of the compressor device 1 according to the invention, that is directly related to this, is that no or hardly any compressed air is lost when the screw compressor 2 is stopped.

It will be understood that this constitutes an important energy saving.

Another aspect is that the aforementioned extra non-return valves in the oil return pipe and in the outlet pipe in the known compressor devices, must be pushed open during operation such that large energy losses occur, which do not occur with a compressor device 1 according to the invention.

In addition, the characteristic of a compressor device 1 according to the invention that the motor chamber 12 and the compression chamber 3 are not sealed off from one another, is also very advantageous in combination with another preferred characteristic of a compression device 1 according to the invention, more specifically that the screw compressor 2 is a vertical screw compressor 2, which yields other important technical advantages, as will be demonstrated hereinafter.

A vertical screw compressor 2 here means that the rotor shafts 8 and 9 of the compressor rotors 5 and 6, as well as the motor shaft 13 of the drive motor 10, during normal operation of the screw compressor 1 extend along axial directions AA', BB' and CC' that are vertical, or at least deviate greatly from the horizontal plane.

According to an even more preferred embodiment of a compressor device 1 according to the invention, the compression housing 4 hereby forms a base 49 or bottom part of the entire compressor housing 48 of the screw compressor 2, while the motor housing 11 forms a head 50 or top part of the compressor housing 48.

Furthermore, the low pressure ends 17 of the compressor rotors 5 and 6 are preferably the ends 17 that are the closest to the head 50 of the compressor housing 48, and the high pressure ends 27 of the compressor rotors 5 and 6 are the ends 27 that are the closest to the base 49 of the compressor housing 48, so that the inlet 24 for drawing in air and the low pressure side of the screw compressor 2 are higher than the outlet 26 for removing compressed air.

This configuration is particularly useful to obtain simple cooling and primarily lubrication of the drive motor 10 and compressor rotors 5 and 6.

The components of the screw compressor 2 that certainly must be lubricated and cooled are of course the components that rotate, more specifically the compressor rotors 5 and 6, the motor shaft 13, as well as the bearings with which these components are supported in the compressor housing 48.

A useful bearing arrangement is also shown in FIG. 2, as it enables the motor shaft 13 and the rotor shaft 8 and/or rotor shaft 9 to be constructed with a limited cross-section, or at least with a smaller cross-section than is generally the case with the known screw compressors of similar type.

In this case the rotor shafts 8 and 9 are hereby supported at both ends 12 and 13 by a bearing, while the motor shaft 13 is also supported by bearings at its end 51 on the head side of the compressor housing 48.

More specifically, the compressor rotors 5 and 6 are supported axially and radially in the compressor housing 48 by bearings at their high pressure end 27, by means of a number of outlet bearings 52 and 53, in this case respectively a cylindrical bearing or needle bearing 52 in combination with a deep groove ball bearing 53.

On the other hand, at their low pressure end 17 the compressor rotors 5 and 6 are only radially supported in the compressor housing 48 by bearings, by means of an inlet bearing 54, which in this case is also a cylindrical bearing or needle bearing 54.

Finally, at the end 50 opposite the driven compressor rotor 5, the motor shaft 13 is supported axially and radially in the compressor housing 48 by bearings, by means of a motor bearing 55, which in this case is a deep groove ball bearing 55.

Tensioning means 56 are hereby provided at the end 51, in this case in the form of a spring element 56, and more specifically a cupped spring washer 56, that is affixed between the motor bearing 55 and a cover 57 of the motor housing.

These tensioning means 56 are intended to exert an axial pre-load on the motor bearing 55, and this pre-load is oriented along the axial direction CC' of the motor shaft 13 in the direction against the force generated by the meshed compressor rotors 5 and 6, so that the axial bearing 53 at the high pressure end of the compressor rotors 5 and 6 are somewhat relieved.

Of course many other bearing arrangements for supporting the rotor shafts 8 and 9 and the motor shaft 13, realised with all kinds of different bearings, are not excluded from the invention.

For cooling and lubricating the screw compressor 2, the compressor device 1 according to the invention is preferably provided with a fluid 46, for example an oil, but another fluid is not excluded, with which both the drive motor 10 and the compressor rotors 5 and 6 are cooled or lubricated, and preferably both the cooling function and the lubricating function are fulfilled by the same fluid 46.

Moreover, a compressor device according to the invention is provided with a return circuit 58 for the removal of fluid 46 from the outlet 26 in the base 49 of the screw compressor 2 and for returning the removed fluid 46 to the head 50 of the compressor housing 48.

In the example shown in FIGS. 1 and 2 the aforementioned return circuit 58 is formed by the set consisting of the outlet pipe 31, the pressure vessel 32, and the oil return pipe 41.

During the operation of the compressor device 1, the fluid 46 is hereby driven through the return circuit 58 from the base 49 to the head 50 of the compressor housing 48 as a result of a compressor pressure generated by the compressor device 1 itself.

Moreover, the outlet pipe 31 is connected to the base 49 of the compressor housing 48 and the oil return pipe 41 is connected to the head 50 of the compressor housing 48.

First and foremost a cooling circuit 59 is connected to the aforementioned return circuit 58, to cool both the drive motor 10 and the screw compressor 2.

Fluid 46 can flow through this cooling circuit 59 from the head 50 of the compressor housing 48 to the base 49 of the compressor housing 48.

More specifically the cooling circuit 59 consists of cooling channels 60 that are provided in the motor housing 11 and from the compressor chamber 3 itself, whereby the cooling channels 60 extend from the oil return pipe 41 to the compression chamber 3.

The majority of the flow of fluid that is returned via the return circuit 58 hereby flows through the cooling circuit 59, except for a small part for lubrication, as will be explained hereinafter.

In order to obtain a sufficient flow rate of fluid 46 through the cooling channels 60 in the motor housing 11, according to a preferred embodiment according to the invention, use is made of a certain driving force that is generated by a compressor pressure of the compressor device 1.

This is also indeed the case in the embodiment of FIGS. 1 and 2, as the return circuit 58 starts from the side of the compression chamber 3 at the base 49 of the compressor housing 48, and this side of the compression chamber 3 is located at the high pressure end 27 of the compressor rotors 5 and 6.

The cooling channels 60 in the motor housing 11 through which the fluid 46 flows during the operation of the screw compressor 2, also ensure that the fluid 46 does not get into the air gap between the motor rotor 20 and the motor stator 21, which would give rise to energy losses and similar.

Furthermore, the return circuit 58 is also connected to a lubrication circuit 61 for lubricating the motor bearing 55 or the motor bearings 55, as well as the inlet bearings 54.

This lubrication circuit 61 consists of one or more branches 62 to the cooling channels 60 in the motor housing 11 for the supply of fluid 46 to the motor bearing 55 or motor bearings 55, and of outlet channels 63 for removing fluid 46 from the motor bearing 55 or motor bearings 55 up to the inlet bearings 54, from where the fluid 46 can flow in the compression chamber 3.

The flow of fluid 46 in the lubrication circuit 61 is hereby substantially lower than in the cooling circuit 59, and the flow of fluid 46 in the lubrication circuit 61 primarily takes place under the effect of gravity.

Another advantageous characteristic is that under the motor bearing 55 there is a reservoir 64 for receiving the fluid 46, to which one or more branches 62 and outlet channels 63 are connected, that are affixed in the motor housing 11 to guide the fluid 45 to the motor bearing 55 and to the inlet bearings 54 respectively.

Moreover, the reservoir 64 is preferably sealed from the motor shaft 13 by means of a labyrinth seal 65.

In the example shown, the cooling channels 60 are primarily axially oriented, and in some parts are also radially oriented, but the direction of these cooling channels 60 does not play so much of a role as a good flow of the fluid 46 is assured under the influence of the imposed compression pressures in these cooling channels 60.

Furthermore, a lubrication circuit 66 is provided in the base 49 for lubricating the outlet bearings 52 and 53.

This lubrication circuit 66 consists of one or more supply channels 67 for the supply of fluid 46 from the compression chamber 3 to the outlet bearings 52 and 53, as well as one or more outlet channels 68 for the return of fluid 46 from the outlet bearings 52 and 53 to the compression chamber 3.

Hereby it is advantageous for the outlet channels 68 to lead to the compression chamber 3 above the entrance of the supply channels 67 in order to obtain the necessary pressure difference for a smooth flow of fluid through the lubrication circuit 66.

It will be understood that according to the invention a very simple and efficient system is realised for lubricating the various bearings 51 to 54, as well as for cooling the drive motor 10 and the compressor rotors 5 and 6.

The use according to the invention of a compressor device according to the invention is also very advantageous.

It is hereby the intention that when the screw compressor 2 starts, up, whereby no pressure has yet built up in the pressure vessel 32, the self-regulating inlet valve 24, which is constructed as a non-return valve 29, opens automatically through the action of the screw compressor 2 and a compression pressure is built up in the pressure vessel 32.

Then, when the screw compressor 2 is stopped, the non-return valve 37 on the pressure vessel 32 automatically closes the air outlet 34 of the pressure vessel 32, and the inlet valve 29 also automatically hermetically closes the inlet pipe 28, so that, after the screw compressor 2 has stopped, both the pressure vessel 32 and the compression chamber 3 and motor chamber 12 of the screw compressor 2 remain under compression pressure.

Thus little or no compressed air is lost.

Moreover, pressure can be built up much more quickly when restarting, which enables a more flexible use of the screw compressor and also contributes to the more efficient use of energy.

When restarting the screw compressor 2, whereby there is still a compression pressure in the pressure vessel 32, the inlet valve 29 first closes automatically until the compressor rotors 5 and 6 reach a sufficiently high speed, after which the self-regulating inlet valve 29 opens automatically under the suction effect created by the rotation of the compressor rotors 5 and 6.

The present invention is by no means limited to the embodiments of a compressor device 1 according to the invention described as an example and shown in the drawings, but a compressor device 1 according to the invention can be realised in all kinds of variants and in different ways, without departing from the scope of the invention.

The invention is also by no means limited to the use of compressor device 1 according to the invention described in this text, but such a compressor device 1 according to the invention can be used in many other ways without departing from the scope of the invention.

The invention claimed is:

1. A compressor device comprising:

a screw compressor with a compression chamber that is formed by a compression housing, in which a pair of meshed compressor rotors in the form of a screw are rotatably mounted, said compression housing comprising an inlet to the screw compressor for the supply of air and an outlet from the screw compressor for the discharge of compressed air, and which is connected to a pressure vessel via an outlet pipe;

a drive motor that is provided with a motor chamber formed by a motor housing, in which a motor shaft is rotatably mounted that drives at least one of the aforementioned two compressor rotors;

the pressure vessel connected to the screw compressor via the outlet pipe including a separator and a return pipe for returning a fluid to both the screw compressor and drive motor;

an air outlet on the pressure vessel for the supply of the compressed air from the pressure vessel to a consumer;

a control system for controlling one or more liquid or gas flows in the compressor device; said control system being provided with:

an inlet valve on the inlet of the screw compressor; and, a tap or valve to close and open the air outlet of the pressure vessel;

wherein the compression housing and the motor housing are connected directly to one another to form a compressor housing, whereby the motor chamber and the compression chamber are not sealed off from one another and the compressor device is configured to supply the fluid through the compressor housing for cooling and lubrication of both the drive motor and the compressor rotors with the fluid, whereby the outlet pipe between the pressure vessel and the screw compressor is free of closing means in order to enable a flow through the outlet pipe in both directions, and wherein, when the screw compressor is stopped, the pressure vessel, the compression chamber, and the motor chamber are configured in a way to remain under a uniform pressure so that little or none of the compressed air is lost.

2. The compressor device according to claim 1, wherein the inlet valve is a non-controlled or self-regulating valve.

3. The compressor device according to claim 2, wherein the inlet valve is a non-return valve.

4. The compressor device according to claim 1, wherein during the operation of the screw compressor, or when the compressed air is drawn off from the pressure vessel by a consumer in the outlet pipe, a mixture of the compressed air and the aforementioned fluid flows.

5. The compressor device according to claim 4, wherein the fluid is an oil and wherein the pressure vessel provided with the oil separator is configured so that, when the aforementioned mixture flows, the oil separator separates the mixture into two flows, on the one hand a flow of compressed air via the air outlet of the pressure vessel and on the other hand a flow of oil via a separate oil outlet on the pressure vessel.

6. The compressor device according to claim 5, wherein an oil return pipe is provided at the oil outlet of the pressure vessel, which is connected to the screw compressor for the reinjection of oil.

7. The compressor device according to claim 6, wherein the oil return pipe is free of self-regulating non-return valves.

8. The compressor device according to claim 6, wherein a part of the oil return pipe is constructed as a radiator that is cooled by means of a forced airflow of surrounding air originating from a fan.

9. The compressor device according to claim 8, wherein a bypass pipe is also provided in the oil return pipe that is affixed in parallel over the part of the oil return pipe with the radiator.

10. The compressor device according to claim 9, wherein the control system comprises one or more controlled valves that are provided in the oil return pipe, and which enables the oil flow to be controlled such that the oil is either driven through the radiator in order to cool the oil, or through the bypass pipe in order not to cool the oil.

11. The compressor device according to claim 1, wherein the air outlet comprises a consumer pipe connected to the pressure vessel that can be closed by the tap or the valve, whereby a section of the consumer pipe is constructed as a radiator that is cooled by means of a forced airflow of surrounding air originating from a fan.

12. The compressor device according to claim 1, wherein the air outlet of the pressure vessel is also equipped with a non-return valve.

13. The compressor device according to claim 1, wherein the screw compressor is a vertical screw compressor, whereby the two compressor rotors have rotor shafts that extend along a first axial direction and a second axial direction and the motor shaft extends along a third axial direction and whereby the aforementioned axial directions of the compressor rotors and the motor shaft are vertical during normal operation of the screw compressor.

14. The compressor device according to claim 13, wherein the motor shaft is directly coupled to one of the rotor shafts of the compressor rotors and extends along an axial direction in line with the axial direction of the rotor shaft of the compressor rotor concerned or that the motor shaft also forms the rotor shaft of one of the compressor rotors.

15. The compressor device according to claim 14, wherein the compression housing forms a base or bottom section of the compressor housing, and that the motor housing forms a head or top section of the compressor housing.

16. The compressor device according to claim 15, wherein the compression chamber provided with the inlet for drawing in air that is provided near a low pressure end of the pair of meshed compressor rotors, wherein this low pressure end is the end of the pair of compressor rotors that is closest to the head of the compressor housing, and the outlet for removing the compressed air is provided near a high pressure end of the pair of meshed compressor rotors, wherein this high pressure end is the end of the pair of compressor rotors that is closest to the base of the compressor housing.

17. The compressor device according to claim 1, wherein a return circuit is provided for removing the fluid from the outlet in a base of the screw compressor, and for returning the removed fluid to a head of the compressor housing.

18. The compressor device according to claim 17, wherein the aforementioned return circuit is formed by the set consisting of the outlet pipe, the pressure vessel and an oil return pipe, whereby during the operation of the compressor device the fluid is driven through the return circuit from the base to the head of the compressor housing as a result of a compressor pressure generated by the compressor device.

19. The compressor device according to claim 18, wherein the outlet pipe is connected to the base of the compressor housing, and the oil return pipe is connected to the head of the compressor housing.

20. The compressor device according to claim 17, wherein the aforementioned return circuit is connected to a cooling circuit for cooling both the drive motor and the screw compressor and through which the fluid can flow from the head of the compressor housing to the base of the compressor housing.

21. The compressor device according to claim 20, wherein the cooling circuit consists of cooling channels that are provided in the motor housing and of the compression chamber itself.

22. The compressor device according to claim 20, wherein the majority of the flow of fluid, that is returned via the return circuit, flows through the cooling circuit.

23. The compressor device according to claim 17, wherein the return circuit is connected to a lubrication circuit for lubricating a motor bearing or motor bearings as well as inlet bearings.

24. The compressor device according to claim 1, wherein each of the compressor rotors have a high pressure end that is supported axially and radially in the compressor housing by means of one or more outlet bearings.

25. The compressor device according to claim 24, wherein a lubrication circuit is provided in a base for lubricating the outlet bearings, consisting of one or more supply channels for the supply of the fluid from the compression chamber to the outlet bearings, as well as one or more outlet channels for the return of the fluid from the outlet bearings to the compression chamber.

26. The compressor device according to claim 1, wherein the compressor rotors have a low pressure end that is only supported radially in the compressor housing by bearings.

27. The compressor device according to claim 1, wherein the motor shaft, at the end opposite the driven compressor rotor, is supported axially and radially in the compressor housing by means of one or more motor bearings.

28. The compressor device according to claim 27, wherein the motor shaft is supported in the compressor housing at its end opposite the driven compressor rotor by bearings, said bearings comprising a motor bearing that is a deep groove ball bearing, and further comprising a tensioning element configured to exert an axial pre-load on the deep groove ball bearing, and this pre-load is oriented along the axial direction of the motor shaft.

29. The compressor device according to claim 1, wherein the drive motor is of a type that can withstand compressor pressure.

30. The compressor device according to claim 1, wherein the drive motor is of a type that can generate a sufficiently large start-up torque to start up the screw compressor when the compression chamber is under compressor pressure.

31. The compressor device according to claim 1, wherein when starting up the screw compressor, whereby no pressure has yet built up in the pressure vessel, the inlet valve is configured to automatically open due to the action of the screw compressor and a compression pressure is built up in the pressure vessel.

32. The compressor device according to claim 31, wherein when the screw compressor is stopped, a non-return valve on the pressure vessel is configured to automatically close the air outlet of the pressure vessel and the inlet valve is configured to also hermetically close an inlet pipe on the inlet of the screw compressor.

33. The compressor device according to claim 32, wherein when the screw compressor restarts, whereby there is still a compression pressure in the pressure vessel, the inlet valve is configured to first automatically remain closed until the compressor rotors reach a sufficiently high speed, after which the inlet valve is configured to automatically open under the suction effect created by the rotation of the compressor rotors.

34. A compressor device comprising:

a screw compressor with a compression chamber that is formed by a compression housing, in which a pair of meshed compressor rotors in the form of a screw are rotatably mounted;

a drive motor that is provided with a motor chamber formed by a motor housing, in which a motor shaft is rotatably mounted that drives at least one of the aforementioned two compressor rotors;

an inlet to the screw compressor for the supply of air;

an outlet to the screw compressor for the discharge of compressed air, and which is connected to a pressure vessel via an outlet pipe;

an air outlet on the pressure vessel for the supply of the compressed air from the pressure vessel to a consumer;

a control system for controlling one or more liquid or gas flows in the compressor device; said control system being provided with:

an inlet valve on the inlet of the screw compressor; and, a tap or valve to close and open the air outlet of the pressure vessel;

wherein the compression housing and the motor housing are connected directly to one another to form a compressor housing, whereby the motor chamber and the compression chamber are not sealed off from one another and whereby the outlet pipe between the pressure vessel and the screw compressor is free of closing means in order to enable a flow through the outlet pipe in both directions, wherein, when the screw compressor is stopped, the pressure vessel, the compression chamber, and the motor chamber are configured in a way to remain under a uniform pressure so that little or none of the compressed air is lost, wherein the screw compressor is provided with a fluid, with which both the drive motor and the compressor rotors are cooled and lubricated, wherein a return circuit is provided for removing fluid from the outlet in a base of the screw compressor, and for returning the removed fluid to a head of the compressor housing, wherein the return circuit is connected to a lubrication circuit for lubricating a motor bearing or motor bearings as well as inlet bearings, and wherein the lubrication circuit consists of one or more branches of cooling channels in the motor housing for supplying fluid to the motor bearing or the motor bearings, and of outlet channels for the removal of fluid from the motor bearing or the motor bearings up to the inlet bearings from where the fluid can flow in the compression chamber.

35. The compressor device according to claim 34, wherein the flow of the fluid in the lubrication circuit primarily takes place under the effect of gravity.

36. The compressor device according to claim 34, wherein, at the motor bearing or the motor bearings, a reservoir is provided for receiving fluid that is sealed off from the motor shaft by means of a labyrinth seal.

37. A compressor device comprising:

a screw compressor with a compression chamber that is formed by a compression housing, in which a pair of meshed compressor rotors in the form of a screw are rotatably mounted, said compression housing comprising an inlet to the screw compressor for the supply of air and an outlet from the screw compressor for the discharge of compressed air, and which is connected to a pressure vessel via an outlet pipe;

a drive motor that is provided with a motor chamber formed by a motor housing, in which a motor shaft is rotatably mounted that drives at least one of the aforementioned two compressor rotors;

the pressure vessel connected to the screw compressor via the outlet pipe including a separator and a return pipe for returning a fluid to both the screw compressor and drive motor;

an air outlet on the pressure vessel for the supply of the compressed air from the pressure vessel to a consumer;

a control system for controlling one or more liquid or gas flows in the compressor device; said control system comprising:

an inlet valve on the inlet of the screw compressor; and, a tap or valve to close and open the air outlet of the pressure vessel;

wherein the compression housing and the motor housing are connected directly to one another to form a compressor housing, whereby the motor chamber and the compression chamber are not sealed off from one another and the compressor device is configured to supply the fluid through the compressor housing for cooling and lubrication of both the drive motor and the compressor rotors with the fluid, whereby the outlet pipe between the pressure vessel and the screw compressor is free of closing means in order to enable a flow through the outlet pipe in both directions, and wherein, when the screw compressor is stopped, the pressure vessel, the compression chamber, and the motor chamber are configured in a way to remain under a uniform pressure so that little of the compressed air is lost, and wherein the screw compressor is a vertical screw compressor, and comprises a first compressor rotor having a first rotor shafts that extends along a first axial direction and a second compressor rotor having a second rotor shaft that extends along a second axial direction, and wherein the motor shaft extends along a third axial direction, and the aforementioned axial directions of the compressor rotors and the motor shaft are vertical during normal operation of the screw compressor, and wherein the motor shaft forms a rotor shaft of one of the compressor rotors, and said rotor shaft is formed as a single piece.

* * * * *